US010052870B2

(12) United States Patent
Sakai

(10) Patent No.: US 10,052,870 B2
(45) Date of Patent: Aug. 21, 2018

(54) LIQUID SUPPLY SUBSTRATE, METHOD OF PRODUCING THE SAME, AND LIQUID EJECTING HEAD

(71) Applicant: CANON KABUSHIKI KAISHA, Tokyo (JP)

(72) Inventor: Toshiyasu Sakai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/345,350

(22) Filed: Nov. 7, 2016

(65) Prior Publication Data

US 2017/0129241 A1 May 11, 2017

(30) Foreign Application Priority Data

Nov. 11, 2015 (JP) ..... 2015-221453

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14088* (2013.01); *B41J 2/1404* (2013.01); *B41J 2/1408* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1634* (2013.01); *B41J 2002/14467* (2013.01)

(58) Field of Classification Search

CPC .... B41J 2/1408; B41J 2/14088; B41J 2/1404; B41J 2/14129

USPC ..... 347/20, 54, 56, 61

See application file for complete search history.

(56) References Cited

U.S. PATENT DOCUMENTS 8,434,850 B2 * 5/2013 Ibe ..... B41J 2/14129 347/18

8,690,295 B2 4/2014 Bengali et al.

* cited by examiner

*Primary Examiner* — An Do

(74) *Attorney, Agent, or Firm* — Canon U.S.A., Inc. IP Division

(57) ABSTRACT

A first substrate including a plurality of supply ports through which a liquid is supplied to a position of an electrothermal conversion element and a second substrate including a common liquid supply chamber from which the liquid is supplied to the plurality of supply ports are coupled together with an intermediate layer therebetween. The intermediate layer includes a first region and a second region having lower thermal conductivity than the first region.

17 Claims, 6 Drawing Sheets

LIQUID SUPPLY SUBSTRATE, METHOD OF PRODUCING THE SAME, AND LIQUID EJECTING HEAD

BACKGROUND OF THE INVENTION

Field of the Invention

The present invention relates to a liquid supply substrate for supplying a liquid to a liquid ejecting head, a method of producing the liquid supply substrate, and a liquid ejecting head.

Description of the Related Art

In a liquid ejecting head mounted in an inkjet recording apparatus, for example, ejection ports through which a liquid is ejected, a liquid channel through which the liquid is guided to the ejection ports, and a plurality of energy generating elements each configured to provide energy for causing the liquid to be ejected through the ejection ports are placed on a substrate in high density. The substrate includes a liquid supply port through which the liquid is supplied to the plurality of energy generating elements.

U.S. Pat. No. 8,690,295 discloses a method of forming a liquid supply port by dry etching in a substrate on which energy generating elements and a liquid channel through which ink is guided to ejection ports are placed in high density.

A liquid ejecting head may include an energy generating element in the form of an electrothermal conversion element, which is configured to convert electricity to heat such that the thermal energy causes a liquid to be ejected. In such a liquid ejecting head, the temperature of the substrate may be increased by the heat generated by the electrothermal conversion element, leading to unstable ejection. The increase in temperature of the substrate is reduced if ink to be supplied to the energy generating element after each of the ejection operations has a low temperature and the electrothermal conversion element has high heat dissipation efficiency, for example.

In the liquid ejecting head disclosed in U.S. Pat. No. 8,690,295, however, the heat generated by the electrothermal conversion element tends to be transferred to the ink in the liquid supply port through the silicon substrate. Thus, the ink to be supplied to the electrothermal conversion element has an increased temperature. This lowers the heat dissipation efficiency of the electrothermal conversion element, leading to unstable ejection.

SUMMARY OF THE INVENTION

The present invention provides a liquid supply substrate configured to supply a liquid to a chamber in a liquid ejecting head in which the liquid in the chamber is ejected through an ejection port by thermal energy transferred from an electrothermal conversion element to the liquid, the liquid supply substrate including a first substrate having a first surface connected to an ejection port plate including the chamber and the ejection port, the first substrate including a plurality of supply ports through which the liquid is supplied to the chamber; a second substrate coupled to a second surface of the first substrate opposite the first surface, the second substrate including a common liquid supply chamber from which the liquid is supplied to the plurality of supply ports; and an intermediate layer disposed between the first substrate and the second substrate, the intermediate layer including a first region and a second region having lower thermal conductivity than the first region.

Further embodiments, features and aspects of the present invention will become apparent from the following description of various embodiments with reference to the attached drawings.

DESCRIPTION OF THE EMBODIMENTS

The present invention was made to solve the above-described issue. The present invention provides a liquid supply substrate having a configuration in which driving of an electrothermal conversion element is less likely to increase a temperature of an overall substrate.

First Embodiment

Figure 1A:
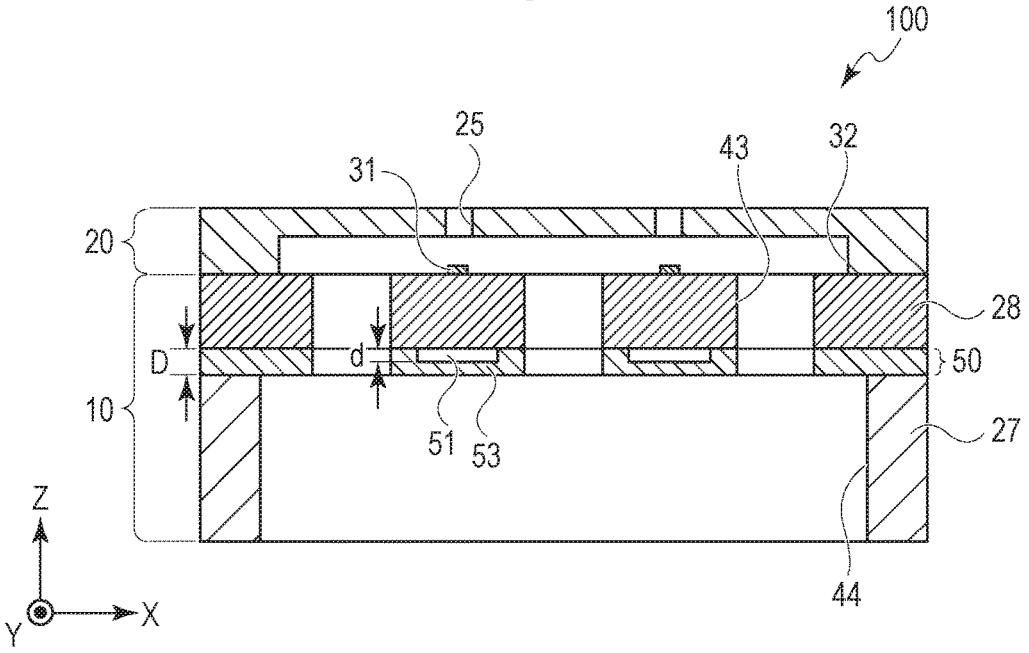
FIGS. 1A and 1B are views of a liquid ejecting head according to an example first embodiment.
Figure 1B:
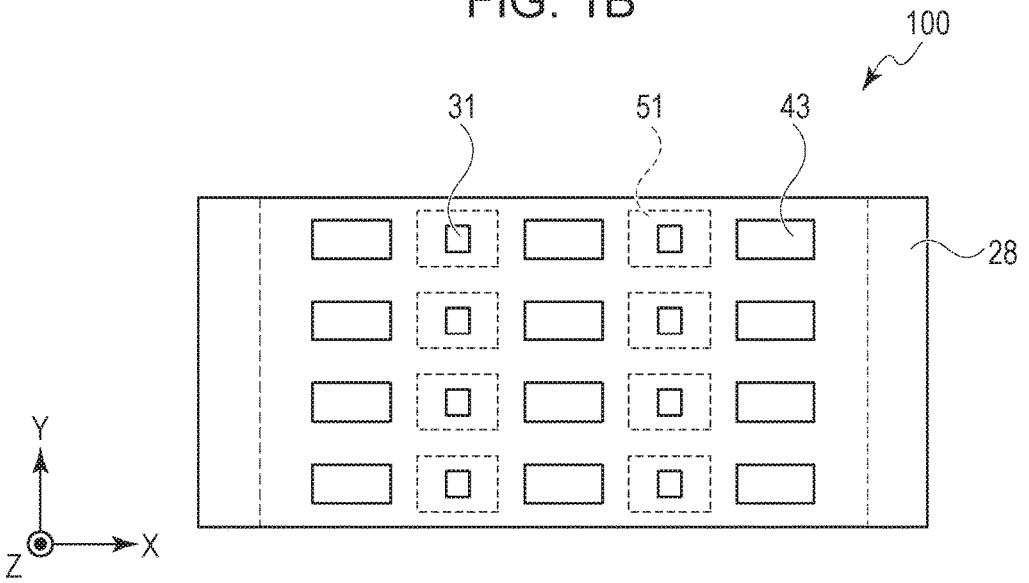

FIGS. 1A and 1B are a cross-sectional view and a top view, respectively, of an example of a liquid ejecting head 100 according to a first embodiment. In the liquid ejecting head 100 of the first embodiment, an ejection port plate 20 is disposed on a liquid supply substrate 10. In the top view in FIG. 1B, the ejection port plate 20 of the liquid ejecting head 100 is not illustrated.

As illustrated in FIG. 1A, the liquid supply substrate 10 of the first embodiment has a three-layered structure including a first silicon substrate 28, which corresponds to a first substrate, a second silicon substrate 27, which corresponds to a second substrate, and an intermediate layer 50 disposed between the first and second silicon substrates 28 and 27. A common liquid supply chamber 44, which extends through the second silicon substrate 27 in the Z direction and extends in the Y direction, is in communication with a plurality of supply ports 43 in the first silicon substrate 28 at an opening on the positive Z direction side. The supply ports 43 each extend through the first silicon substrate 28 in the Z direction and are in communication with a chamber 32 in the ejection port plate 20. The ejection port plate 20 includes a plurality of ejection ports 25. Electrothermal conversion elements 31 are disposed on the first silicon substrate 28 at positions facing the respective ejection ports 25.

The intermediate layer 50 is mainly formed of a silicon oxide film, for example. The intermediate layer 50 includes a first region and a second region. Herein, a region of the intermediate layer 50 that is formed of the silicon oxide film is referred to as a first region 53 and a hollow region of the intermediate layer 50 is referred to as a second region 51. In other words, the portion formed of the silicon oxide film and the hollow region constitute the intermediate layer 50. As illustrated in FIG. 1B, the second region 51, which is a hollow region, is placed at positions corresponding to the respective electrothermal conversion elements 31 in the X-Y plane. The second region 51 has a thickness d in the Z direction that is substantially half the thickness D of the intermediate layer 50. The first region 53, which is a portion of the intermediate layer 50 formed of the silicon oxide film in the first embodiment, has thermal conductivity of 1.36 W/mK. The second region 51 (air in the second region) has thermal conductivity of 0.026 W/mK. The thermal conductivity of the second region 51 is smaller than that of the first region 53.

When the liquid in the chamber 32 supplied from the common liquid supply chamber 44 through the supply ports 43 receives energy from the electrothermal conversion elements 31, the liquid is ejected through the corresponding ejection ports 25 in a direction perpendicular to a surface of the ejection port plate 20. Specifically, application of a voltage pulse to the electrothermal conversion elements 31 at a predetermined timing heats the electrothermal conversion elements 31. This causes film boiling in the liquid in the chamber 32 in contact with the electrothermal conversion elements 31. The growth energy of the bubble generated by the film boiling causes the liquid in the chamber 32 to be ejected through the ejection ports 25.

In the above-described configuration, some of the thermal energy generated by the electrothermal conversion elements 31 is consumed as the above-described ejection energy, and the remaining thermal energy, which remains in the form of thermal energy, is transferred to the first silicon substrate 28 and further to the liquid in the supply ports 43 and to the intermediate layer 50. However, since the intermediate layer 50 includes the second region 51, which has thermal conductivity sufficiently lower than that of the first region 53, the heat transferred to the first silicon substrate 28 is less likely to be transferred to the negative Z direction side, and is mainly transferred to the liquid in the supply ports 43 adjacent to the first silicon substrate 28 in the X direction. This reduces the increase in temperature of the liquid in the common liquid supply chamber 44, which is positioned on the negative Z direction side of the intermediate layer 50, and improves the heat dissipation efficiency of the electrothermal conversion elements 31 during the ejection.

Figure 2A:
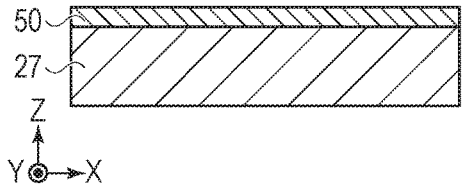
FIGS. 2A to 2J are views illustrating steps of producing the liquid ejecting head.

FIGS. 2A to 2J are views illustrating steps of producing the liquid ejecting head 100 according to the present embodiment. Initially, as illustrated in FIG. 2A, a substrate in which a layer to be the intermediate layer 50 (hereinafter, the layer is simply referred to as the intermediate layer 50) is disposed on the second silicon substrate 27 is provided. For example, a silicon oxide film having a thickness of 4 μm is formed on the second silicon substrate 27 having a thickness of 500 μm. The silicon oxide film is the intermediate layer 50.

Figure 2D:
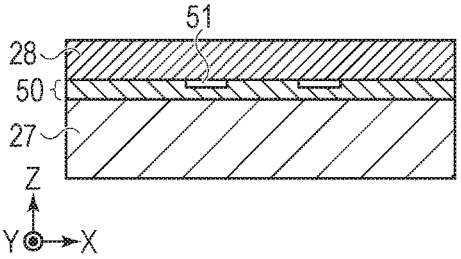
Figure 2B:
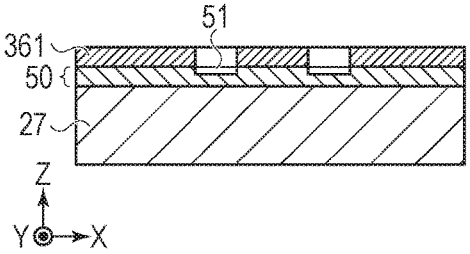
Figure 2E:
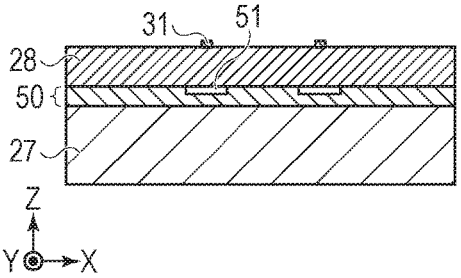
Figure 2C:
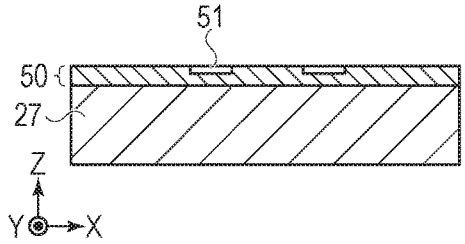

Then, a mask 361 is disposed on an upper side of the intermediate layer 50 in the Z direction and a dry etching process is performed (FIG. 2B). An example of the dry etching process includes a reactive ion etching process. A widely-used positive photoresist is used as the mask 361. The etching depth d is half the depth D of the intermediate layer 50. For example, when the depth D is 4 μm, the depth d is 2 μm. Then, the mask 361 is removed. As a result, a recess to be the second region 51 is formed in the intermediate layer 50 (FIG. 2C).

Then, the first silicon substrate 28 having a thickness of 200 μm is connected to an upper side of the intermediate layer 50 in the Z direction (FIG. 2D). Direct connection, which does not require an adhesive, may be employed for the connection.

A plurality of electrothermal conversion elements 31 and components such as wiring and a circuit for supplying electricity to the electrothermal conversion elements 31 are disposed on the first silicon substrate 28. The electrothermal conversion elements 31 are disposed at positions corresponding to the second regions 51 (FIG. 2E) formed in the step illustrated in FIG. 2C.

Figure 2F:
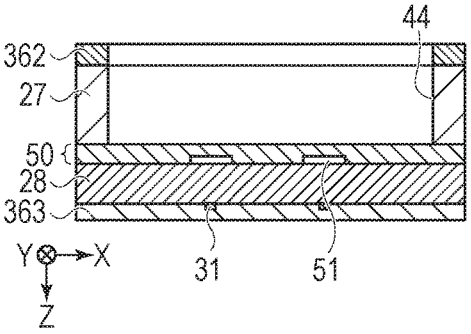
Figure 2G:
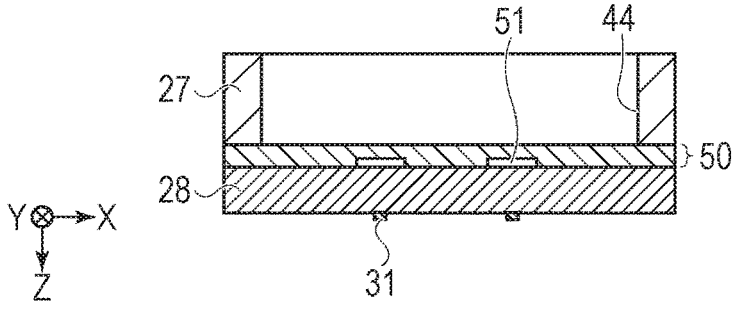

Then, the obtained layered structure is turned upside down. A common liquid supply chamber mask 362 is disposed on a surface of the second silicon substrate 27 on the negative Z direction side, i.e., on a surface of the second silicon substrate 27 away from the intermediate layer 50, and a protective film 363 is disposed on a surface of the first silicon substrate 28 on the positive Z direction side. Then, the dry etching process is performed on the negative Z direction side of the second silicon substrate 27. A widely-used positive photoresist is used as the common liquid supply chamber mask 362 and the protective film 363. The selectivity of the intermediate layer 50, which is a silicon oxide film, is high in silicon etching, and the intermediate layer 50 functions as an etching stopping layer. Thus, as illustrated in FIG. 2F, the common liquid supply chamber 44 extending through the second silicon substrate 27 to the intermediate layer 50 is formed in the second silicon substrate 27 by the etching process. FIG. 2G shows a state in which the common liquid supply chamber mask 362 and the protective film 363 are removed.

Figure 2H:
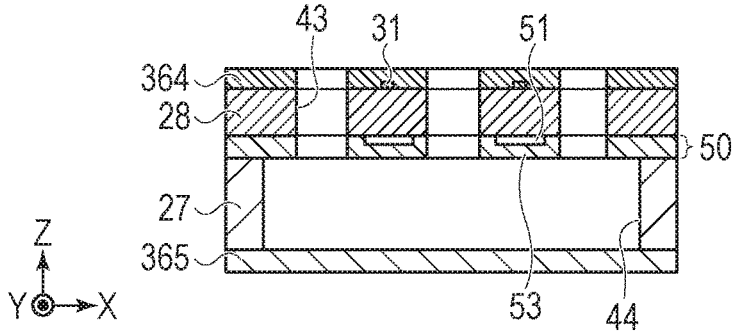
Figure 2I:
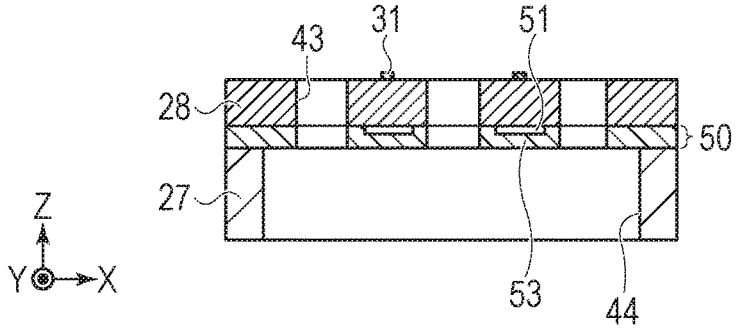

Then, the obtained layered structure is turned upside down again. A supply port formation mask 364 is disposed on a surface of the first silicon substrate 28 on the positive Z direction side, and an etching stopping film 365 is disposed on a surface of the second silicon substrate 27 on the negative Z direction side. Then, the dry etching process is performed on the positive Z direction side of the first silicon substrate 28. A widely-used positive photoresist is used as the supply port formation mask 364, and a widely-used back grinding tape attached to the second silicon substrate 27 is used as the etching stopping film 365. In the dry etching process, the silicon etching process continues until the intermediate layer 50 is reached, and then an oxide layer etching process continues until the second silicon substrate 27 is reached. As a result, as illustrated in FIG. 2H, a plurality of supply ports 43 extending through the first silicon substrate 28 to the second silicon substrate 27 are formed. FIG. 2I shows a state in which the supply port formation mask 364 and the etching stopping film 365 are removed.

In this step, other processes than the dry etching process, such as a wet etching process and a laser process, may be employed. The employment of the dry etching process enables high accuracy positioning of the supply ports 43, i.e., the supply ports 43 are reliably able to be formed at positions away from the second regions 51 having low thermal conductivity.

Figure 2J:
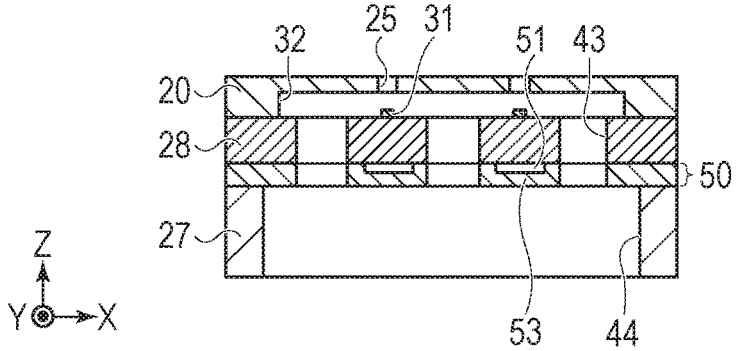

In addition, the ejection port plate 20 is formed on the first silicon substrate 28 as illustrated in FIG. 2J by repeating lamination of a photosensitive resin layer in dry film form, exposure, and development. The ejection ports 25 and the chamber 32, which are hollow structures, are formed by making the first photosensitive resin layer and the second photosensitive resin layer to have different exposure sensitivities. The liquid ejecting head 100 of the present embodiment is obtained by the above-described steps.

Second Embodiment

Figure 3A:
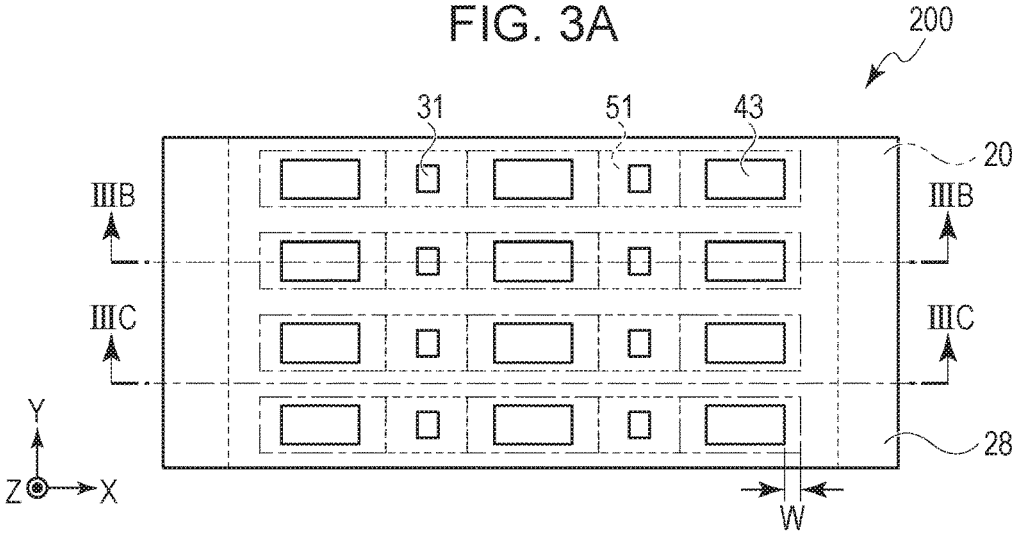
FIGS. 3A to 3C are views of a liquid ejecting head according to an example second embodiment.
Figure 3B:
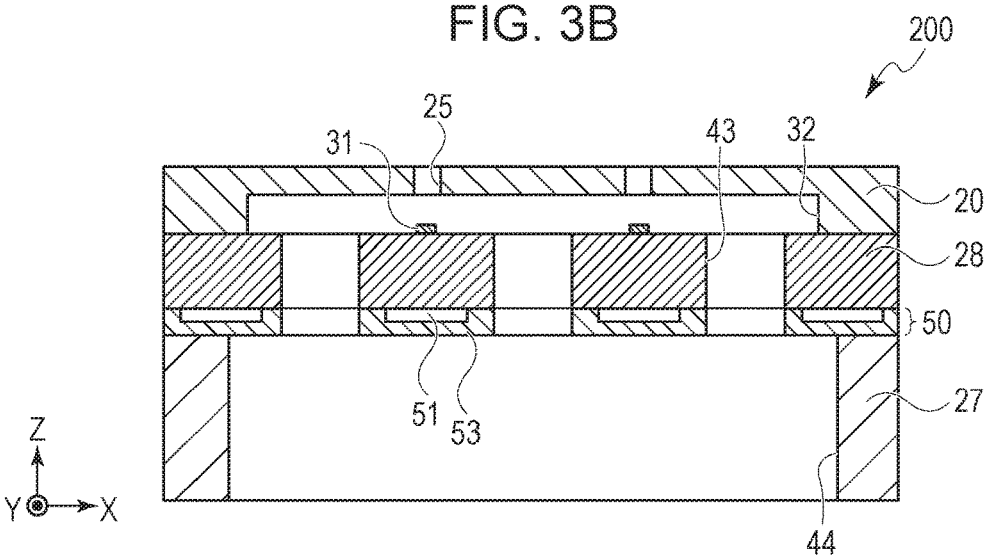
Figure 3C:
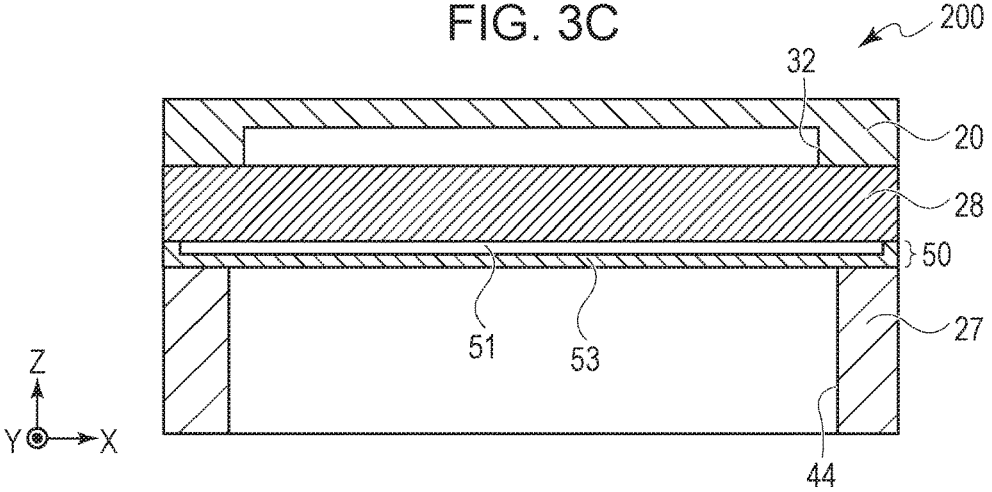

FIGS. 3A to 3C are a top view and cross-sectional views of an example of a liquid ejecting head 200 according to a second embodiment. In the first embodiment, the second regions 51 are provided at positions corresponding to the respective electrothermal conversion elements 31, i.e., only directly below the electrothermal conversion elements 31. However, in the second embodiment, the second region 51 extends over almost all area of the intermediate layer 50, which extends along the X-Y plane (area of a surface of the intermediate layer 50 in a plane parallel to the surface of the first substrate), except for the portions having the supply ports 43. The "almost all area" means 90% or more of the area of the intermediate layer 50 except for the portions having the supply ports 43, for example. FIG. 3A is a top view of the liquid ejecting head 200 of the second embodiment in which the ejection port plate 20 is not illustrated. FIG. 3B is a cross-sectional view taken along line IIIB-IIIB in FIG. 3A. FIG. 3C is a cross-sectional view taken along line IIIC-IIIC in FIG. 3A.

The liquid ejecting head 200 of the second embodiment is also able to be produced by the steps illustrated in FIG. 2A to 2I. In the production step of the liquid ejecting head 200, the step in FIG. 2B employs a mask that does not cover almost all area of the intermediate layer 50 except for portions having the supply ports 43 instead of the mask that does not cover only the portions of the intermediate layer 50 corresponding to the electrothermal conversion elements 31. This enables the second region 51 to extend over almost all area of the intermediate layer 50 except for the portions having the supply ports 43. However, as illustrated in FIG. 3A, if the distance W between the side edge of the supply port 43 and the second region 51 is too small, the intermediate layer 50 may detach from the first silicon substrate 28. In the second embodiment, the distance W is made larger (W=3 μm) than that in the first embodiment to provide sufficient connection strength. The second embodiment having the above-described configuration provides the liquid ejecting head 200 having higher heat dissipation efficiency than that in the first embodiment.

Third Embodiment

Figure 4A:
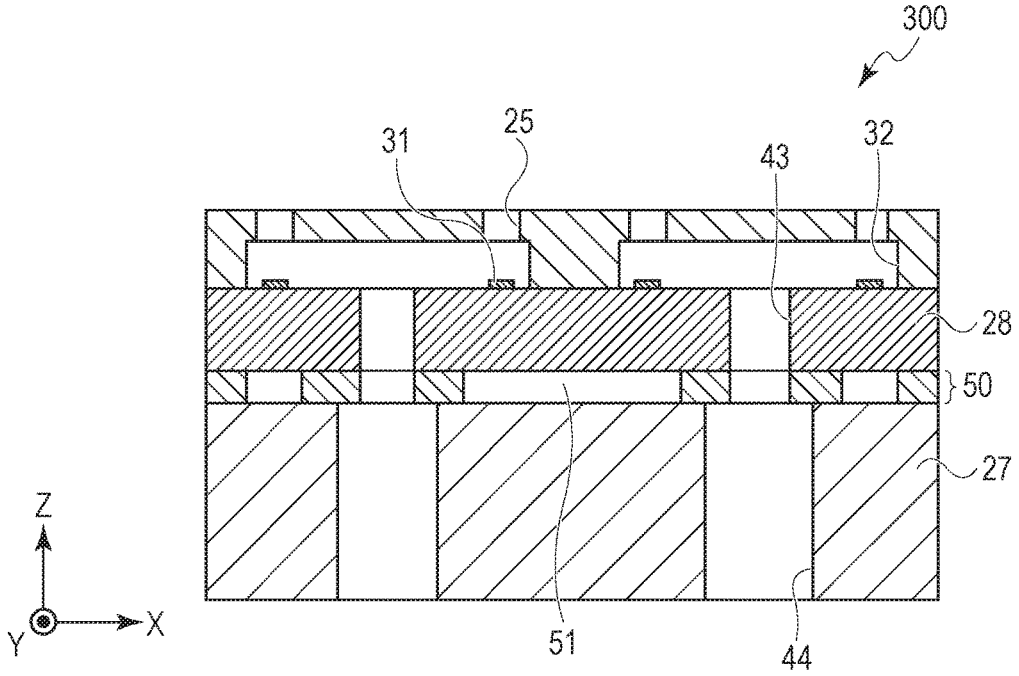
FIGS. 4A and 4B are views of a liquid ejecting head according to an example third embodiment.
Figure 4B:
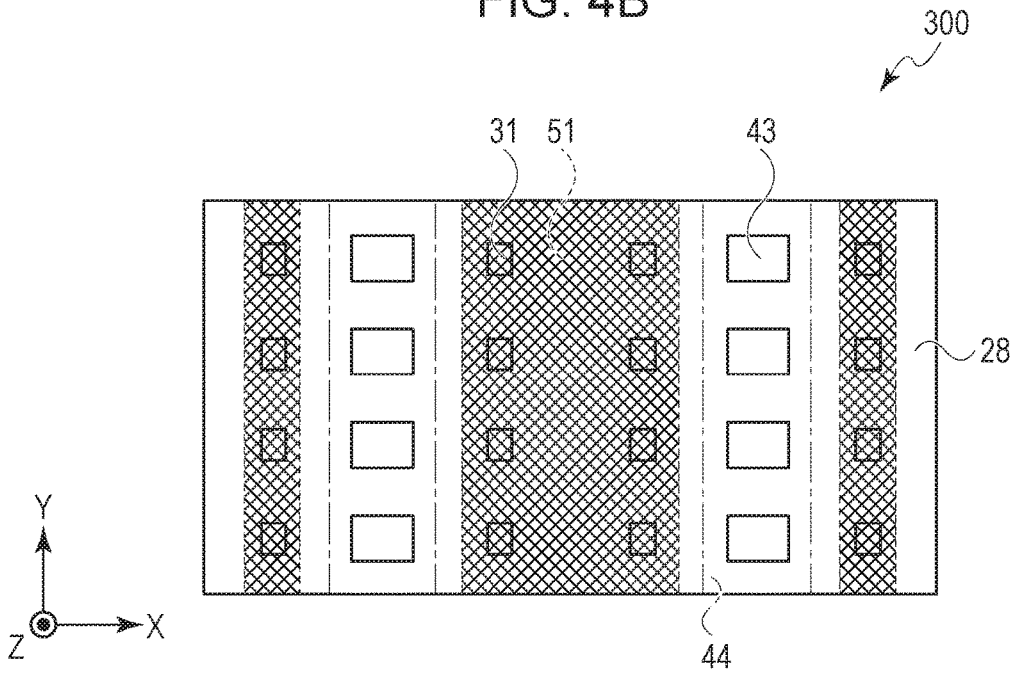

FIGS. 4A and 4B are a cross-sectional view and a top view, respectively, of an example of a liquid ejecting head 300 according to a third embodiment. Only components of the third embodiment different from those of the first embodiment are described. The second silicon substrate 27 of the third embodiment includes two common liquid supply chambers 44 extending in parallel in the Y direction. The common liquid supply chambers 44 are in communication with corresponding supply ports 43 arranged in the Y direction. In addition, the ejection port plate 20 includes two chambers 32 corresponding to the respective common liquid supply chambers 44. The chambers 32 are in communication with the supply ports 43 arranged in the Y direction. The chambers 32 each extend in the positive and negative X directions from the positions where the chamber 32 is in communication with the supply ports 43 and are in communication with the respective ejection ports 25 at the ends on the positive and negative X direction sides. The electrothermal conversion elements 31 are disposed on the first silicon substrate 28 at positions facing the ejection ports 25. In this embodiment, the two common liquid supply chambers 44 may supply the same liquid or different liquids.

As in the first embodiment, the intermediate layer 50 formed of a silicon oxide film is disposed between the first silicon substrate 28 and the second silicon substrate 27. The second region 51 in this embodiment extends through a portion of the intermediate layer 50 in the Z direction to the surface of the second silicon substrate 27. In other words, the second silicon substrate 27 on the negative Z direction side, the first silicon substrate 28 on the positive Z direction side, and portions (the first regions 53) of the intermediate layer 50 on the positive and negative X direction sides define the second region 51 in this embodiment.

In this configuration, some of the thermal energy generated by the electrothermal conversion elements 31 is consumed as the ejection energy. The remaining thermal energy, which remains in the form of thermal energy, is transferred to the first silicon substrate 28, and further transferred to the liquid in the supply ports 43 and to the first and second regions 53 and 51 of the intermediate layer 50. However, since the second region 51 has smaller thermal conductivity than the other portions, the heat transferred to the first silicon substrate 28 is less likely to be dispersed in the negative Z direction and is mainly transferred to the liquid in the supply ports 43 adjacent to the first silicon substrate 28 in the X direction and to the first region 53 of the intermediate layer 50 near the supply ports 43. Thus, the heat is unlikely to be transferred through the second region 51 to the second silicon substrate 27 adjacent to the second region 51 in the negative Z direction, leading to an improvement in heat dissipation efficiency of the electrothermal conversion elements 31 during the ejection.

The liquid ejecting head 300 of the third embodiment is also produced by the steps illustrated in FIGS. 2A to 2I. In the production of the liquid ejecting head 300, as indicated by shaded regions in FIG. 4B, the step in FIG. 2B employs a mask that does not cover all the area of the intermediate layer 50 extending in the Y direction except for regions near the supply ports 43, instead of a mask that does not cover only the regions corresponding to the electrothermal conversion elements 31. Then, the etching process is performed until the second silicon substrate 27 is reached.

In addition, instead of the common liquid supply chamber mask 362 used in the step illustrated in FIG. 2F, which does not cover portions corresponding to all the supply ports 43 of the first silicon substrate 28, a mask that does not cover portions of the second silicon substrate 27 corresponding to the supply ports 43 arranged in the Y direction is used to form the common liquid supply chambers 44. In addition, in the step illustrated in FIG. 2H, the supply ports 43 arranged in the Y direction are formed at positions corresponding to the common liquid supply chambers 44.

In the first embodiment, since a lower layer, which has a thickness of 2 μm, of the intermediate layer 50 is in contact with the common liquid supply chamber 44, the heat transferred to a portion around the second region 51 may be transferred to the common liquid supply chamber 44. However, in the third embodiment, since the second region 51 extends through a portion of the intermediate layer 50 in the Z direction, the liquid ejecting head 300 has higher heat dissipation efficiency than that of the first embodiment.

Fourth Embodiment

Figure 5:
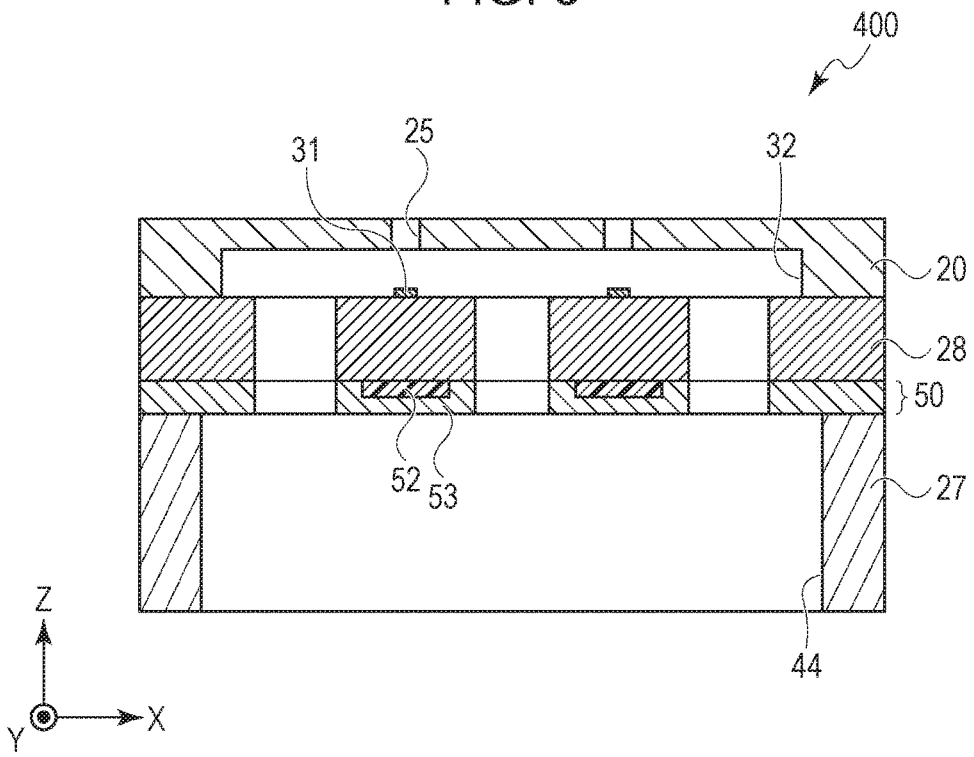
FIG. 5 is a view of a liquid ejecting head according to an example fourth embodiment.

FIG. 5 is a cross-sectional view of an example of a liquid ejecting head 400 according to a fourth embodiment. The liquid ejecting head 400 of the fourth embodiment differs from the liquid ejecting head of the first embodiment in that a second region 52 of the liquid ejecting head 400 is not hollow, but filled with resin. In other words, the second region 52 is formed of resin. This structure is obtained by filling the resin such as polyimide in the recess formed in the step in FIG. 2C and then performing the connection step in FIG. 2D, for example. The thermal conductivity of polyimide is higher than that of air, but sufficiently lower than that of silicon or a silicon oxide film. Thus, as in the above-described embodiments, heat dissipation efficiency of the electrothermal conversion elements 31 in the fourth embodiment is high during the ejection compared to that in the conventional technique.

In an example in FIG. 5, the second regions 51 of the first embodiment are all replaced with the second regions 52 filled with resin. The second region 52 filled with resin of the present embodiment is applicable to any of the first to third embodiments. All of the second regions 51 in the first, second, or third embodiment are not necessarily replaced with the second regions 52 filled with resin of the fourth embodiment. The hollow second region 51 and the second region 52 filled with resin may be both provided in one intermediate layer 50. When all the second regions 51 are hollow as in the first to third embodiments, the heat dissipation efficiency is improved, but the strength of the liquid ejecting head, which is formed of thin films, is reduced by an amount corresponding to the area of the second regions 51. This may cause a crack. The second region 52 filled with resin as in the fourth embodiment reduces the deterioration in the strength of the liquid ejecting head while improving heat dissipation efficiency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-221453, filed Nov. 11, 2015, which is hereby incorporated by reference herein in its entirety.

What is claimed is:

1. A liquid supply substrate configured to supply a liquid to a chamber in a liquid ejecting head in which the liquid in the chamber is ejected through an ejection port by thermal energy transferred from an electrothermal conversion element to the liquid, the liquid supply substrate comprising:

a first substrate having a first surface connected to an ejection port plate including the chamber and the ejection port, the first substrate including a plurality of supply ports through which the liquid is supplied to the chamber;

a second substrate coupled to a second surface of the first substrate opposite the first surface, the second substrate including a common liquid supply chamber from which the liquid is supplied to the plurality of supply ports; and an intermediate layer disposed between the first substrate and the second substrate, the intermediate layer including a first region and a second region, wherein the second region has lower thermal conductivity than the first region.

2. The liquid supply substrate according to claim 1, wherein each of the first substrate and the second substrate is a silicon substrate, and the first region of the intermediate layer is formed of a silicon oxide film.

3. The liquid supply substrate according to claim 2, wherein the second region is a hollow region.

4. The liquid supply substrate according to claim 2, wherein the second region is formed of resin.

5. The liquid supply substrate according to claim 1, wherein, in a plane parallel to the first surface of the first substrate, the second region is located at a position corresponding to the electrothermal conversion element.

6. The liquid supply substrate according to claim 5, wherein the second region is a hollow region.

7. The liquid supply substrate according to claim 5, wherein the second region is formed of resin.

8. The liquid supply substrate according to claim 1, wherein, in a plane parallel to the first surface of the first substrate, the second region extends over 90% or more of an area of the intermediate layer except for portions having the plurality of supply ports.

9. The liquid supply substrate according to claim 8, wherein the second region is a hollow region.

10. The liquid supply substrate according to claim 8, wherein the second region is formed of resin.

11. The liquid supply substrate according to claim 1, wherein the second region is a hollow region.

12. The liquid supply substrate according to claim 1, wherein the second region is formed of resin.

13. A liquid ejecting head in which a liquid in a chamber is ejected through an ejection port by thermal energy transferred from an electrothermal conversion element to the liquid, the liquid ejecting head comprising:

an ejection port plate including the chamber and the ejection port;

a first substrate connected to an ejection port plate at a first surface and including a plurality of supply ports through which the liquid is supplied to the chamber;

a second substrate coupled to a second surface of the first substrate opposite the first surface, the second substrate including a common liquid supply chamber for supplying the liquid to the plurality of supply ports; and an intermediate layer disposed between the first substrate and the second substrate, the intermediate layer including a first region and a second region, wherein the second region has lower thermal conductivity than the first region.

14. A method of producing a liquid supply substrate comprising:

providing a second substrate on which a silicon oxide film is disposed;

forming a recess in a surface of the silicon oxide film by removing a portion of the silicon oxide film;

coupling a first substrate to the second substrate with the silicon oxide film therebetween to provide an intermediate layer having a first region and a second region, the second region being formed of the recess having lower thermal conductivity than the first region;

disposing an electrothermal conversion element on a surface of the first substrate away from the intermediate layer;

forming a common liquid supply chamber extending through the second substrate, the common liquid supply chamber extending from a surface of the second substrate away from the intermediate layer to the intermediate layer; and forming a plurality of supply ports extending through the first substrate, the plurality of supply ports extending from a surface of the first substrate away from the intermediate layer to the second substrate.

15. The method of producing the liquid supply substrate according to claim 14, wherein the forming the recess includes removing the portion of the silicon oxide film until the second substrate is reached, and the common liquid supply chamber is formed in the second substrate at a position away from the second region.

16. The method of producing the liquid supply substrate according to claim 15, wherein the plurality of supply ports are formed by dry etching.

17. The method of producing the liquid supply substrate according to claim 14, wherein the plurality of supply ports are formed by dry etching.

* * * * *